US009745691B2

(12) United States Patent
Date et al.

(10) Patent No.: US 9,745,691 B2
(45) Date of Patent: Aug. 29, 2017

(54) GARMENT STEAMER AND METHOD FOR THE SAME

(71) Applicant: KONINKLIJKE PHILIPS N.V., Eindhoven (NL)

(72) Inventors: Milind Vishwas Date, Singapore (SG); Yong Jiang, Singapore (SG); Nicholas John Lee, Eindhoven (NL); Maarten Theodoor Henric Pelgrim, Utrecht (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/351,350

(22) PCT Filed: Oct. 15, 2012

(86) PCT No.: PCT/IB2012/055599
§ 371 (c)(1),
(2) Date: Apr. 11, 2014

(87) PCT Pub. No.: WO2013/057651
PCT Pub. Date: Apr. 25, 2013

(65) Prior Publication Data

US 2015/0128664 A1 May 14, 2015

Related U.S. Application Data

(60) Provisional application No. 61/548,257, filed on Oct. 18, 2011.

(51) Int. Cl.
*A47L 11/34* (2006.01)
*A47L 11/40* (2006.01)
(Continued)

(52) U.S. Cl.
CPC ..... *D06F 87/00* (2013.01); *A47L 11/34* (2013.01); *A47L 11/4086* (2013.01);
(Continued)

(58) Field of Classification Search
CPC ..... A47L 11/34; A47L 11/4086; D06F 73/00; D06F 75/10; D06F 75/12; D06F 75/14;
(Continued)

(56) References Cited

U.S. PATENT DOCUMENTS 3,793,753 A * 2/1974 Engelbart ..... D06F 75/30 38/77.6
3,919,793 A * 11/1975 Toft ..... D06F 75/18 38/77.83
(Continued)

FOREIGN PATENT DOCUMENTS

BE 1015696 A3 7/2005
CN 201362798 Y 12/2009
(Continued)

*Primary Examiner* — Michael Barr
*Assistant Examiner* — Levon J Shahinian

(57) ABSTRACT

A garment steamer (1) comprising a base body (10) accommodating a liquid water tank (26); a liquid water pump (32), having a water inlet (32*a*) and a water outlet (32*b*), wherein the water inlet (32*a*) is fluidly connected to the liquid water tank (26). The garment steamer also comprises a steam head (50) that is moveable with respect to the base body (10) and that accommodates a steam chamber (70), having a liquid water inlet and a steam outlet, wherein said steam outlet includes at least one steam nozzle (76); a heating element (72) that is provided in or adjacent said steam chamber (70), and configured to evaporate liquid water passing through said steam chamber. A liquid water tube (38*b*, 38*c*) fluidly interconnects the water outlet (32*b*) of the water pump (32) and the liquid water inlet of the steam chamber (70) in the steam head (50).

17 Claims, 5 Drawing Sheets

(51) Int. Cl.
*D06F 73/00* (2006.01)
*D06F 75/12* (2006.01)
*D06F 75/20* (2006.01)
*D06F 87/00* (2006.01)

(52) U.S. Cl.
CPC ..... *D06F 73/00* (2013.01); *D06F 75/12* (2013.01); *D06F 75/20* (2013.01)

(58) Field of Classification Search
CPC ..... D06F 75/16; D06F 75/18; D06F 75/20; D06F 87/00
USPC ..... 68/5 A, 5 R, 12.18, 222
See application file for complete search history.

(56) References Cited

U.S. PATENT DOCUMENTS 4,578,884 A * 4/1986 Nakao ..... D06F 75/14 38/77.3
4,833,298 A * 5/1989 Wilkins ..... B44C 7/027 392/399
5,430,963 A 7/1995 Kuo-Chu
6,073,301 A 6/2000 Berfield
2005/0081923 A1* 4/2005 Benedictus ..... B01F 5/0495 137/564.5
2007/0000159 A1* 1/2007 Kubert ..... D06F 75/18 38/93
2010/0166396 A1 7/2010 Xu et al.

FOREIGN PATENT DOCUMENTS

CN 201770881 U 3/2011
CN 201883320 U 6/2011
FR 2853671 A1 10/2004
GB 161325 A 4/1921
GB 2342101 A 4/2000
GB 2364896 A 2/2002
JP 11989107482 U 7/1989
JP 10127540 A 5/1998
JP 3057428 U 6/1999
JP 2002514950 A 5/2002
WO 2007012721 A2 2/2007
WO 2010122131 A1 10/2010

* cited by examiner

GARMENT STEAMER AND METHOD FOR THE SAME

CROSS-REFERENCE TO PRIOR APPLICATIONS

This application is the U.S. National Phase application under 35 U.S.C. §371 of International Application No. PCT/IB2012/055599, filed on Oct. 15, 2012, which claims the benefit of U.S. Provisional Patent Application No. 61/548,257, filed Oct. 18, 2011. These applications are hereby incorporated by reference herein.

FIELD OF THE INVENTION

The present invention relates to a portable garment steamer, and to a method for steaming a fabric using said garment steamer.

BACKGROUND OF THE INVENTION

To remove wrinkles from fabrics, in particular garments, one may turn to a variety of tools for assistance. Two popular tools for home use are the iron and the garment steamer. Although these devices have a generally similar purpose, they belong to distinct technical classes, each characterized by its own set of constructional features, method of use, performance level and suitability for taking care of certain materials.

From a constructional point of view, the iron sets itself apart from the garment steamer primarily by its relatively heavy, typically hand-sized metal soleplate. The heated soleplate defines the essence of an iron in that it forms the portion thereof that is forced into contact with a fabric being treated so as to heat it, loosen the inter-molecular bonds between its fibers, and mechanically force the fibers into a wrinkle-free state. The weight of the soleplate, and that of the hand-held portion of the iron as a whole for that matter, is beneficial to the iron's operation since it automatically contributes to the pressure that is applied to the fabric. To the user, the iron's weight presents no problem since it is normally supported by an ironing board, and not borne by the user himself. The fabric is thus squeezed between the heated soleplate and the board, possibly under the action of steam that may be released from pores in the soleplate to obtain optimal ironing results.

This is all different for garment steamers. During use the hand-held portion of a garment steamer is in particular not supported on a (horizontal) ironing board. Instead, the hand-held portion is lifted by a user who runs its steam releasing nozzle head up and down a fabric being treated, at a slight distance therefrom or in grazing contact therewith. During such treatment, the fabric may be hanging from a hanger or the like, while the hand of the user not involved in lifting the hand-held portion may keep it in a tensioned, slightly stretched condition. The steam fed to the fabric is to induce stress relaxation, which, in particular under the action of manual stretching, smoothes out any creases therein. In this regard, it may be noted that the weight of the hand-held portion of a garment steamer does not contribute to the device's operation, and must be continuously lifted without the benefit of support by an ironing board. The lack of mechanical squeezing of the fabric during treatment may generally cause a garment steamer's performance to be somewhat less than that of an iron. At the same time, however, more delicate fabrics may preferably be treated with a garment steamer since this does not involve direct contact with a scorching hot soleplate.

Contemporary garment steamers come in two basic models: floor models and hand-held models. A floor model has a (stationary) base unit including a steam generator, and steam head that is connected to the steam generator via a hose that feeds steam from the steam generator to nozzles in the steam head. A floor model type garment steamer typically includes a relatively large water tank, e.g. a 1.5 liter tank, which provides it with a high degree of autonomy (away from the tap), but also renders it rather heavy and bulky. A hand-held model is a unitary device in which the water tank, the steam generator and the nozzled steam head are all integrated in one housing. Due to its smaller water tank a hand-held model is normally lighter and therefore better manageable and more portable than a floor model, but these characteristics are realized at the cost of a significantly smaller autonomy time.

SUMMARY OF THE INVENTION

It is an object of the present invention to overcome or mitigate one or more of the above-mentioned drawbacks associated with known garment steamers.

More in particular, it is an object of the present invention to provide for a garment steamer that is more portable than know floor model steamers, that provides for more of autonomy than known hand-held steamers, and that offers a generally improved manageability/maneuverability of the steam head.

To this end, a first aspect of the present invention is directed to a garment steamer. The garment steamer includes a base body that accommodates a liquid water tank, and a liquid water pump having a water inlet and a water outlet, wherein the water inlet is fluidly connected to the liquid water tank. The garment steamer further includes a steam head that is moveable with respect to the base body. The steam head includes a steam chamber having a liquid water inlet and a steam outlet, wherein the steam outlet includes at least one steam nozzle. The steam head further includes a heating element that is provided in or adjacent said steam chamber, and configured to evaporate liquid water passing there through. The garment steamer also includes a liquid water carrying tube that fluidly interconnects the water outlet of the liquid water pump in the base body and the liquid water inlet of the steam chamber in the steam head.

The presently disclosed garment steamer improves on known floor model garment steamers in that it transports water to the steam head in liquid form, not in the form of steam. This means that the water tube connecting the base unit and the steam head requires no thermal insulation to prevent the cooling of steam and/or the user from burning himself on a steaming hot tube. Accordingly, the water tube may have a thinner wall, and thus a smaller (outer) diameter. Another factor enabling a smaller tube cross-section lies in the fact that liquid water has a significantly higher density than steam, which—for a given steam rate at the steam nozzle—allows it to be transported at a smaller volumetric flow rate. By virtue of its smaller diameter/cross-section, the water tube of the present garment steamer may be less stiff than the steam hoses that normally connect the base unit and the steam head, which results in a better manageability of the latter. With regard to known hand-held steamers, the presently disclosed garment steamer offers an improvement in that its steam head does not include a weighty water tank. Consequently, the steam head is significantly lighter and therefore easier to handle/maneuver. This is in particular true over longer time periods, during which a partially stretched arm carrying even a small water tank could be strained and exhausted easily.

Due to the fact that both the base body and the steam head accommodate one or more electrical components (e.g. the pump and the heating element, respectively), the base body and the steam head may, apart from the liquid water carrying tube, also be interconnected by a set of electrical wires. The electrical wires may in particular serve to provide electrical power and/or signals from the base unit to the steam head, and/or vice versa, as will be elucidated infra. To avoid the risk of entanglement, the tube and the wires may be combined in one flexible connection cord that connects the base body to the steamer head. Since the water tube, which may typically be the widest element to be encompassed by the connection cord and therefore normative for its thickness, may be relatively small in cross-section, the connection cord may preferably have an effective outer diameter smaller than 10 mm, more preferably smaller than 7.5 mm, and most preferably smaller than 6 mm.

In one embodiment of the garment steamer, the water tank has a volume in the range of 350-750 cubic centimeters (cc).

Such a volume is both smaller than the typical minimum volume of about 1000 cc for floor model garment steamers, and larger than the typical maximum of about 250 cc for hand held steamers. Compared to floor model steamers, the smaller weight and volume of the water tank of the present garment steamer make it less bulky and increases its portability. At the same time, the smaller weight and volume of the water tank provide the presently disclosed garment steamer with a higher degree of autonomy than associated with known hand-held steamers, whose high refill rate disadvantageously affects user comfort.

The garment steamer according to the present invention may be relatively lightweight. Specifically, the steam head (i.e. the hand-held portion) may preferably have a dry mass smaller than 800 grams, and more preferably smaller than 750 grams, so as to warrant excellent portability. In addition, to prevent the steaming head from getting heavy during use, the steam head may preferably not include a liquid water reservoir (e.g. in the form of a liquid water line section) with a volume larger than 15 cubic centimeters.

In one embodiment, the garment steamer may further comprise a fastener that is attached to said base body, and that is configured to enable a user to fasten the base body to his body.

A faster may, for example, include a waist clip or a waist belt. Such a fastener for carrying the base body accommodating the water tank prevents a user from either having to find a suitable support for the base body, or from carrying it manually. In practice, a suitable support for the base body may be hard to find at the location where steaming is desired. Due to the fact that it is relatively lightweight, for example, it may easily be pulled of its support and fall. If it were alternatively supported on the ground, a user might step on it and break it. The fastener solves this problem. It enables a user to carry the base body in a steady orientation, virtually without effort, and without the use of a hand. In addition, if the faster is held on the waist, it may offer the advantage that the connection cord between the base body and the steam need not be excessively long; about twice the length of an arm will normally do.

In another embodiment of the garment steamer, the water pump is a diaphragm pump.

In principle, the garment steamer according to the present invention may be used with any suitable type of pump. A diaphragm pump is particularly advantageous, however, because of its good dry running characteristics, which prevent damage to the pump when the water tank accidentally runs empty during use.

In another embodiment the garment steamer may comprise a liquid water flow control valve that is disposed in either the fluid connection between the water tank and the water inlet of the water pump, or the liquid water tube.

In particular in embodiments in which the pump can merely be switched on and off, a (liquid water) flow control valve may be inserted in the water line running from the water tank to the steam chamber. The flow control valve may be electrically or manually operable to enable metering of the water flow, and hence the steam rate of the garment steamer.

In still another embodiment, the base body of the garment steamer may define a refill opening that provides direct access to the water tank.

Since the water in the water tank of the presently disclosed garment steamer need not be pressurized during operation, the base body may define a (preferably non-closable) refill opening that allows the water tank to be refilled during use, simply by pouring water into it.

In a further embodiment, the steam head of the garment steamer may comprise a housing that defines an elongate handle section having a first end and a second end and that is configured to be gripped by a hand of a user, a nozzle head that is provided at the first end of the handle section and that includes said at least one steam nozzle, and a steam guard that extends away from said nozzle head, and at least partially around it.

The steam guard serves to protect a user's hand gripping the elongate handle section of the steam head's housing from direct contact with the hot steam released through the at least one steam nozzle. It may preferably be formed as a generally sheet- or plate-like collar or flange that extends away from, and at least partially around the nozzle head. In a preferred embodiment, the steam guard may extend away from the nozzle head in a direction having a positive component in a direction extending from the first end of the elongate handle section to the second end thereof. This latter configuration may be particularly advantageous in case the at least one steam nozzle is configured to release steam in a direction that extends at a non-zero angle relative to the longitudinal axis of the elongate handle.

In another embodiment, the at least one steam nozzle may be encircled by a spacer bracket that prevents a substantially planar object from direct contact with said steam nozzle.

In yet another embodiment, the garment steamer may further comprise water treatment means disposed in the water tank and/or the fluid connection between the water tank and the at least one steam nozzle, and configured to reduce or remove scale and/or other impurities from water passing through said water tank or fluid connection. Such means may, for instance, include a water filter, a scale inhibitor, an ion-exchange resin, etc.

In still another embodiment, the garment steamer may include a chemical dispenser that is included in the water tank and/or the fluid connection between the water tank and at least one steam nozzle, and that is configured to give off at least one chemical, e.g. an additive or a fragrance, to water passing by. Such a chemical dispenser may, for example, include a spray head, a piezo-based nebulizer, or a heat-based dispenser.

Another aspect of the present invention is directed to a method of steaming a fabric. The method includes providing a fabric, and providing a garment steamer according to the first aspect of the present invention. The method also includes making the garment steamer generate steam and release said steam through the at least one nozzle of its steam head by having the water pump pump liquid water (typically at ambient temperature) from the water tank, through the liquid water tube, to the steam chamber. The method further includes moving the steam head along the fabric.

These and other features and advantages of the invention will be more fully understood from the following detailed description of certain embodiments of the invention, taken together with the accompanying drawings, which are meant to illustrate and not to limit the invention.

DETAILED DESCRIPTION OF THE EMBODIMENTS

Figure 1:
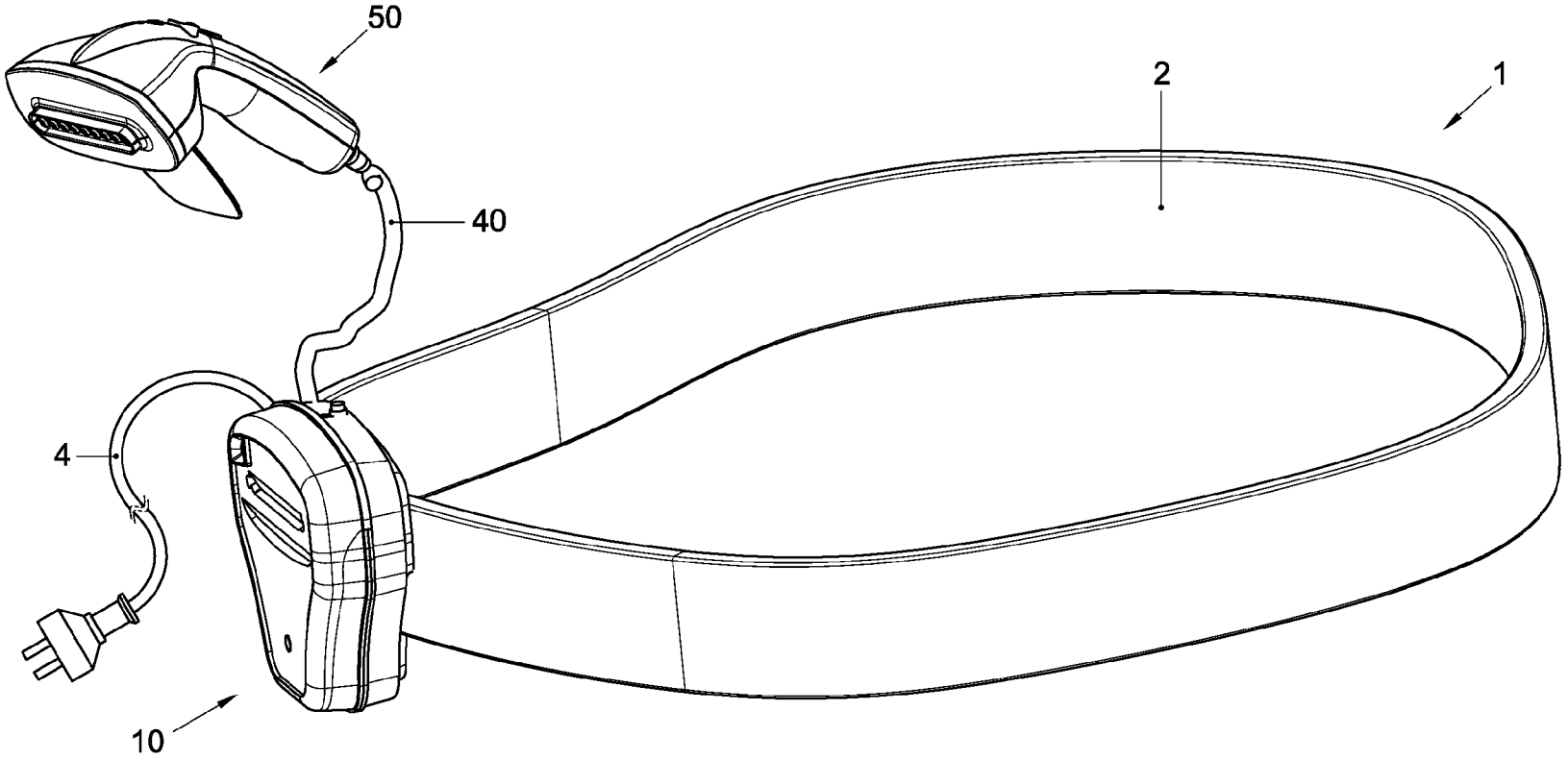
FIG. 1 is a schematic perspective view of an exemplary embodiment of a garment steamer according to the present invention, including a base body that is provided on a waist belt, and a steam head that is connected to the base body via a flexible connection cord.

FIG. 1 is a schematic perspective view of an exemplary embodiment of a garment steamer 1 according to the present invention. The garment steamer includes a base body 10, a steam head 50 that is connected thereto via a flexible connection cord 40. The garment steamer also includes a power cord 4 provided with a plug, which cord is connected to the base body 10 for supplying the garment steamer 1 with electrical power from the mains.

In the depicted embodiment, the base body 10 is provided on a belt 2, e.g. a waist belt, that enables a user to strap the base body 10 to his body, e.g. around his waist. The base body 10 is relatively lightweight, so bearing it is in itself unlikely to present a physical burden to a user. However, holding the base body 10 manually would necessarily take up one of a user's hands. The waist belt 2 overcomes the need to hold base body 10 manually during use, thus freeing that hand, which may then be used for, for example, rearranging a garment being steamed. In an alternative embodiment, the garment steamer 1 may not include a (waist)belt; instead, an outer surface of the bottom or back cover 12 of the base body 10 (see FIG. 2) may be provided with an anti-slip provision, e.g. rubber studs, that allow the base body 10 to be positioned securely on a piece of furniture during use, thereby preventing the relatively light base body 10 from being drawn off its support due to motion of the connection cord 40.

Figure 2:
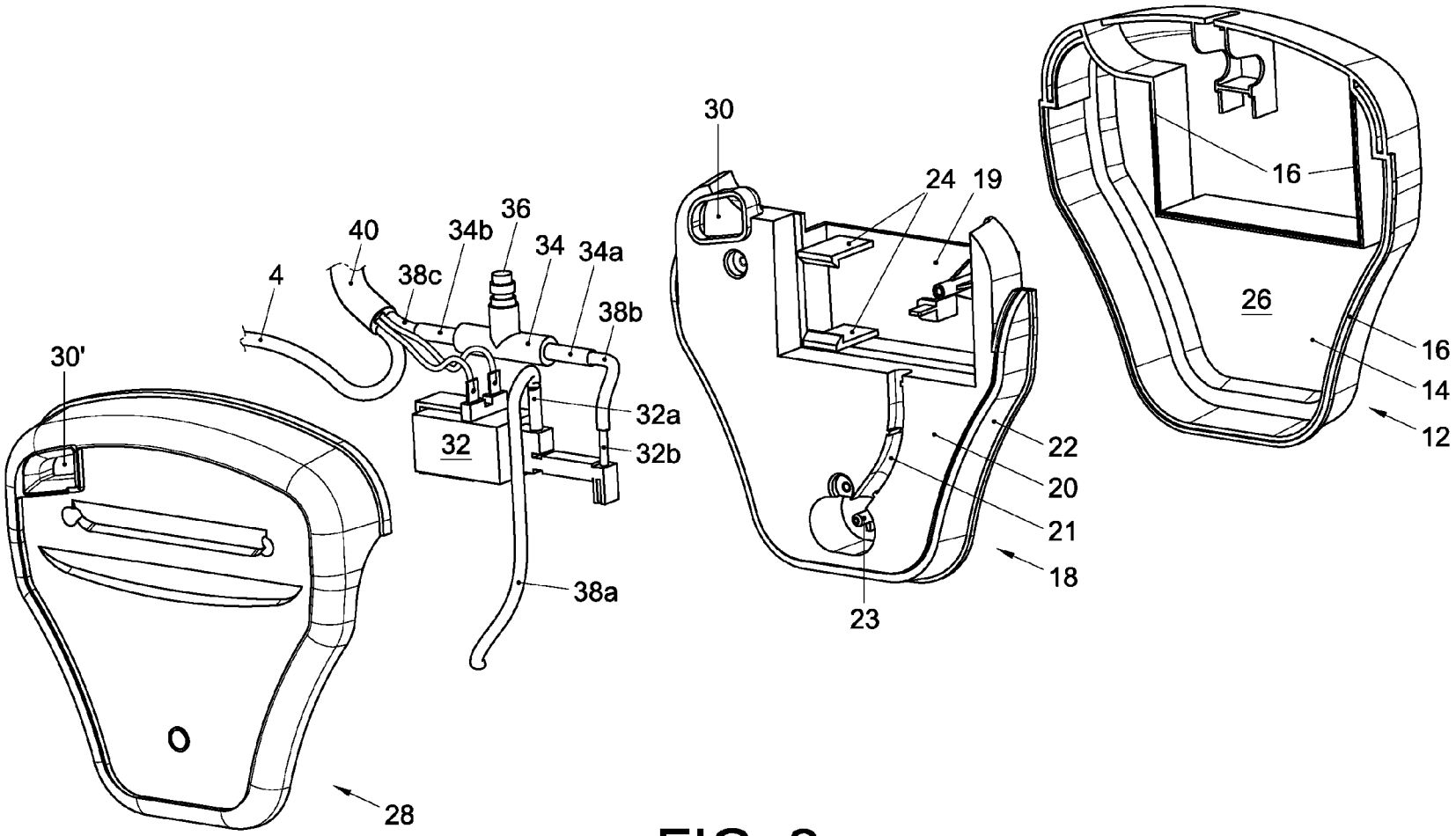
FIG. 2 is a schematic exploded perspective view of the base body of the garment steamer shown in FIG. 1.

The base body 10 is illustrated in more detail in the exploded perspective view of FIG. 2. Here it can be seen that the base body 10 may include a back or bottom cover 12, a tank cover 18, and a top cover 28. The back cover 12 may include a back wall 14 with an upstanding wall 16 provided thereon, which wall 16 may extend partially along and partially within the circumference of the back wall 14. The tank cover 18 may likewise include a front wall 20, and an upstanding wall 22 that extends partially along and partially within the circumference of the front wall 20. The upstanding walls 16, 22 on the back and tank covers 12, 18 may be complementarily shaped, such that, when the two covers 12, 18 are slid onto one another, the back wall 14, the front wall 20 and the upstanding walls 16, 22 together define a water tank 26 between them for storing liquid water.

The tank cover 18 may include an opening 30, which may be disposed in an upper portion of the front wall 20, within the area walled by upstanding wall 22. The front cover 28 may similarly include an opening 30', which may register with that in the tank cover 18 when the base body is assembled, so as to define a refill opening. Since the water in the tank 26 will not be pressurized and the waist-borne base body 10 is expected to maintain its orientation during use, the refill opening need not be closable by means of a valve or the like.

A normally dry side of the front wall 20 of tank cover 18 may define a recessed slot 21. At the end of the slot 21, the front wall 20 may further define a tube connector 23. The tube connector 23 may preferably be disposed in a lower portion of the front wall, within the area walled by the upstanding wall 22, and define a fluid passage through the front wall 20. Due to gravity, water in the water tank 26 will flow towards the tube connector 23, keeping it submerged for as long as there is water left in the water tank 26.

The base body 10 may accommodate an electric (liquid) water pump 32. Within the base body 10, the pump 32 may be held in place by two clamp arms 24 that protrude from a back wall 19 of the tank cover 18, which back wall 19 may be disposed backward of the front wall 20 thereof. A flexible tube section 38*a* may fluidly connect a water inlet 32*a* of the pump 32 to the tube connector 23 on the tank cover 18, so as to enable the pump 32 to pump water from the water tank 26. The pump 32 may in principle be of any suitable type. In a preferred embodiment, however, the pump 32 is a diaphragm or membrane pump. Compared to most other pump types, e.g. plunger pumps, diaphragm pumps have good dry running characteristics, which may prevent damage to the garment steamer 1 in case the water tank 26 runs empty during use.

In the depicted embodiment, the pump 32 may merely be switched on and off by means of a control button 66 on the steamer head 50 (to be discussed infra). That is to say that when the pump 32 is operating, it always pumps at the same rate. This advantageously reduces the structural complexity of the pump control mechanism. Still, other embodiments of the garment steamer 1 may feature an electronic pump control mechanism that facilitates an adjustable pump rate. The present embodiment provides for control over the flow rate of the water to be pumped from the water tank 26 by means of a manually operable flow control valve 34. The flow control valve 34 may generally be disposed anywhere in the portion of the water tube 38 extending from the water tank 26 to the steam generation section 70 in the steam head 50, and thus either upstream or downstream of the pump 32. In the implementation of FIG. 2, the valve 34 is accommodated by the base body 10. A flexible tube section 38*b* connects its water inlet end 34*a* to the water outlet 32*b* of the water pump 32. The flow control valve 34 is fitted with a manual control 36, for example in the form of a rotatable knob, that protrudes from the base body 10 in its assembled state (see FIG. 1). The control 36 may enable a user to increase or decrease the effective diameter of a flow passage within the valve 34, so as to regulate the flow rate of water there through.

It is noted that the base body 10 of the garment steamer 1 according to the present invention does not include a heating element to evaporate water that is extracted from the water tank 26. Instead, the water is transported from the base body 10 to the hand-held steam head 50 in liquid form via flexible tube section 38*c*, which is connected to the water outlet 34*b* of the flow control valve 34. In between the base body 10 and the steam head 50, the flexible tube section 38*c* may be enclosed in a connection cord 40, which may also accommodate electrical power and signal cables.

Transporting the water in the form of liquid instead of steam has a number of advantages. If, for example, the water were to be transported from the base body 10 to the steam head 50 in the form of steam, the tube section 38*c* would effectively represent a heat leak over the length of the connection cord 40. This is because, during use, the tube section 38*c* would form a steam line through an environment at room temperature, and steam flowing through the channel would necessarily cool and possibly even condense, a problem that is indeed encountered in known garment steamers. Heat loss associated with the transfer of steam may be limited by thermally insulating the tube section 38*c*, but this would typically lead to the use of thicker tubing, or require a thicker insulating jacket to be provided by the connection cord 40. As a consequence, the connection cord 40 would become thicker and heavier, and hence, less flexible, which would disadvantageously affect the manageability of the steam head 50. In this regard it deserves mention that, in practice, a steam carrying tube always requires at least some degree of thermal insulation to prevent a user from burning themselves thereon, which causes such tubes to be relatively stiff.

Transporting the water to the steam head 50 in liquid form prevents these problems. Since there is no need for thermal insulation a liquid carrying tube 38 may have a relatively thin outer wall. In addition, the tube 38 may have a relatively small inner cross-section compared to a steam carrying tube suited for the same steam rate because liquid water has a higher density than steam, and may therefore be transported efficiently at low volumetric flow rates. In the garment steamer 1 according to the present invention, the liquid carrying tube 38, and in particular section 38*c* insofar as it extends between the base body 10 and the steam head 50, may preferably have an inner diameter smaller than 2 mm. The connection cord 40, which—as mentioned—may accommodate both (a portion of) the tube section 38*c* and electric power and signal cables, may preferably have an outer diameter smaller than 7.5 mm, and more preferably smaller than 6 mm.

Figure 3:
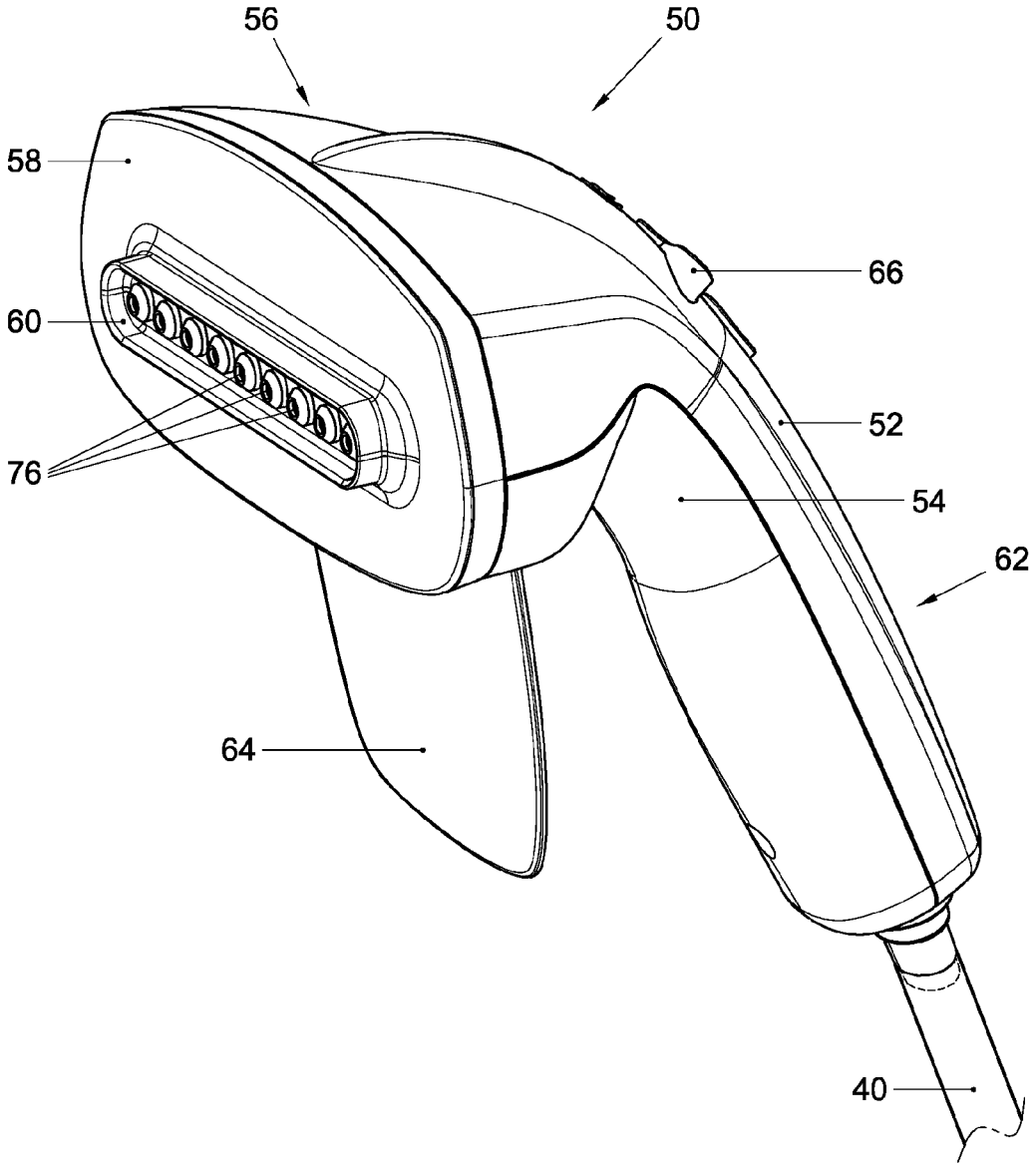
FIG. 3 is a schematic perspective view of the steam head of the garment steamer shown in FIG. 1.
Figure 4:
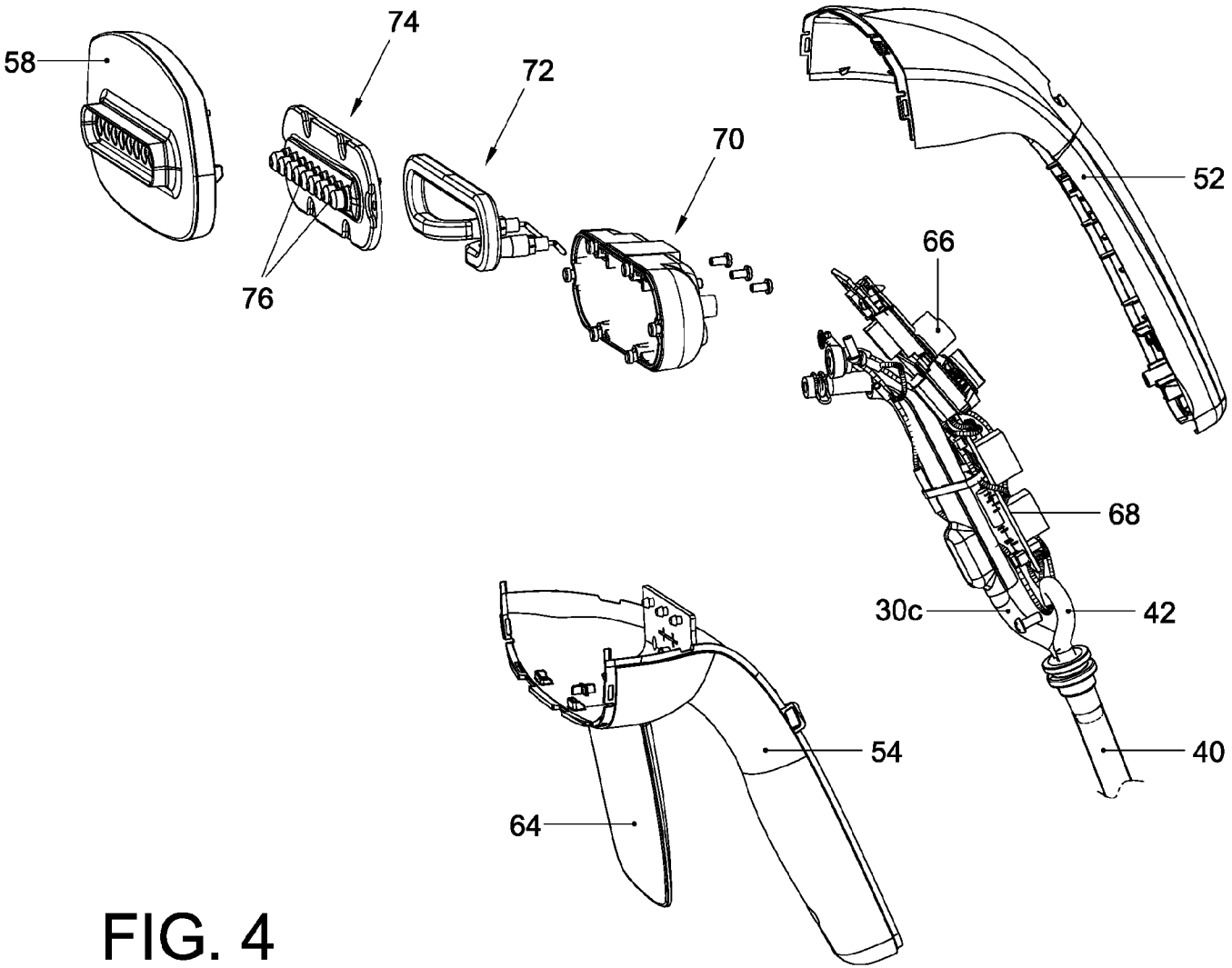
FIG. 4 is a schematic, partially exploded perspective view of the steam head shown in FIG. 3.
Figure 5:
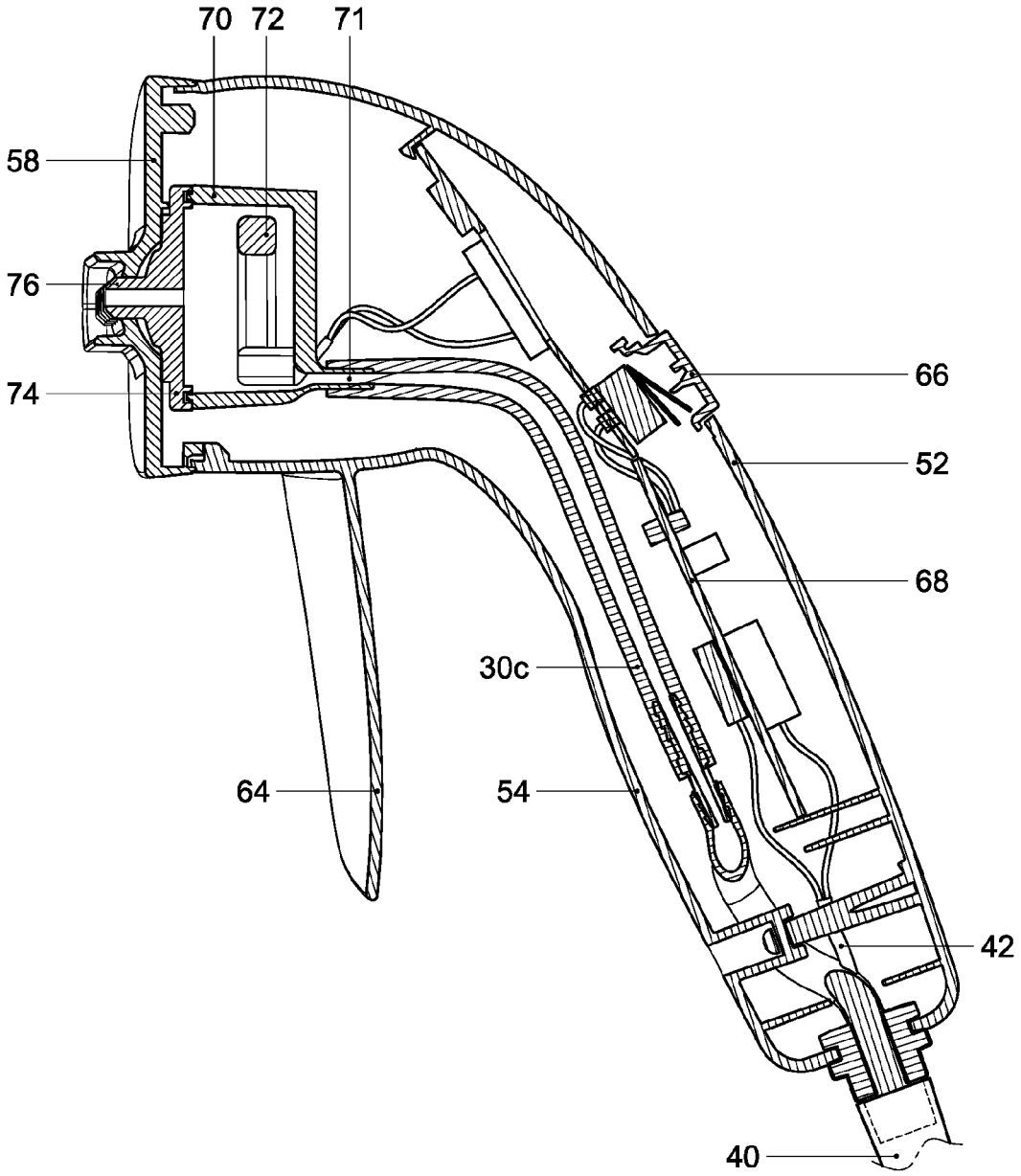
FIG. 5 is a schematic, simplified longitudinal cross-sectional side view of the steam head shown in FIGS. 3 and 4.

At its downstream end, the connection cord 40 connects to the steam head 50. FIGS. 3 and 4 schematically illustrate the steam head 50 in a perspective view and an exploded perspective view, respectively. FIG. 5 is a simplified longitudinal cross-sectional view of the steam head 50, showing only its most relevant inner components in relationship to each other.

Referring now to FIGS. 3-5. The steam head 50 comprises a housing that includes a bottom cover 54, a top cover 52 and a nozzle head cover 58. The covers 52, 54, 58 may preferably be made of a thermally insulating material, such as poly-carbonate, acrylonitrile-butadienestyrene (ABS), polypropylene. In its assembled state, the housing defines an elongate handle section 62 and a nozzle head 56. The nozzle head 56 is fixed to a first end of the handle section 62 opposite to a second end at which the connection cord 40 connects thereto. In the depicted embodiment, the housing also defines a steam guard 64 that is attached to and extends away from the nozzle head 56. The steam guard 64 serves to protect a user's hand gripping the elongate handle section 62 of the steam head's housing from direct contact with the hot steam released through the at least one steam nozzle. It may preferably be formed as a generally sheet- or plate-like collar or flange that extends away from, and at least partially around the nozzle head. In a preferred embodiment, as shown, the steam guard 64 may extend away from the nozzle head 56 in a direction having a positive component in a direction extending from the first end of the elongate handle section 62 to the second end thereof. This latter configuration may be particularly advantageous in case the at least one steam nozzle 76 is configured to release steam in a direction that extends at a non-zero angle relative to the longitudinal axis of the elongate handle.

As can be seen best in FIGS. 4 and 5, the connection cord 40 carries the liquid water tube section 38*c* and an electric cable 42. Upon entering the steam head 50, the tube section 38*c* and the electric cable 42 fork. The wires of the electric cable 42 connect to a printed circuit board (PCB) 68. The PCB 68 may provide for a pump control button 66 that enables switching the pump 32 in the base body 10 on and off. In addition the PCB 68 may include power conversion electronics and a thermostat to power and control the operation of the steam head's heating element 72, which to this end may be electrically connected to the PCB. The tube section 38*c* may extend onwards, through the handle section 62 and along the PCB 68, to fluidly connect to the steam chamber 70 positioned in the nozzle head 56. The steam chamber 70 may generally be defined by a tube section, here a tub-shaped shell, which may be partially closed off with a nozzle plate 74 defining a plurality of nozzles 76. The tub-shaped shell may provide for a tube connector 71 to which tube section 38*c* may be connected, and electric connector passages, via which the electric connections of the heating element 72 may reach out the steam chamber to connect to the PCB 68. The heating element 72 may be disposed within or, alternatively, around the tub-shaped shell of the steam chamber 70, and be thermally coupled thereto.

As may be inferred from the Figures, the steam chamber 70 of the garment steamer 1 according to the present invention is an open water passage, having an entrance in the form of the tube connector 71, and multiple exits in the form of the nozzles 76. Both the entrance 71 and the exits 76 are always open. Accordingly, the garment steamer 1 features an efficient, on the fly steam generation system that produces steam only on direct demand from the user (indicated via the pump control knob 66 on the steam head 50). As steam is produced immediately prior to its release, there is no need for the storage and accumulation of steam in a pressurized state, which simplifies the construction of the garment steamer 1.

In an assembled state of the garment steamer 1, the nozzle plate 74 may abut the nozzle cover 58 of the steam head's housing, such that the nozzles 76 protrude through openings provided therein for that purpose. The nozzle cover 58 may further be provided with a spacer bracket 60 that protrudes from the plane of the steam nozzles 76, and encircles the nozzles 76. During use, the spacer bracket 60 serves to warrant a small distance between the steam nozzles 76 and a locally planar patch of fabric being treated.

The operation of the illustrated garment steamer 1 is as follows. Prior to use, the water tank 26 is filled with water via refill opening 30', and the plug on the power cord 4 is inserted in a power socket to provide the garment steamer with power. This will cause the heating element 72 to heat up to a preset temperature. When the user presses the steam button 66, the electronics on the PCB 68 will activate the pump 32 in the base body 10 via the electrical wires running through the connection cord 40. The pump 32 will then draw liquid water from the water tank 26 through tube section 38*a*, and force it—at a rate allowed by the control valve 34 through tube sections 38*b*, 38*c* to the steam chamber 70 in the steam head 50. Inside the steam chamber 70, the inflow of liquid water is instantly converted into steam, which is subsequently released through the steam nozzles 76.

Although illustrative embodiments of the present invention have been described above, in part with reference to the accompanying drawings, it is to be understood that the invention is not limited to these embodiments. Variations to the disclosed embodiments can be understood and effected by those skilled in the art in practicing the claimed invention, from a study of the drawings, the disclosure, and the appended claims. Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, it is noted that particular features, structures, or characteristics of one or more embodiments may be combined in any suitable manner to form new, not explicitly described embodiments.

The invention claimed is:

1. A garment steamer, comprising:

a base body, the base body comprising:

a liquid water tank;

a liquid water pump, having a water inlet and a water outlet, wherein the water inlet is fluidly connected to the liquid water tank;

a steam head moveable with respect to the base body, the steam head comprising a steam chamber, having a liquid water inlet and a steam outlet, said steam outlet including at least one steam nozzle;

wherein the steam head comprises a housing, said housing defining:

an elongate handle section having a first end and a second end, and configured to be gripped by a hand of a user;

a nozzle head that is provided at the first end of the handle section, said nozzle head including said at least one steam nozzle; and a steam guard that is directly connected to the steam head including a connecting portion directly connected to the nozzle head and an extending U-shaped portion extending downwardly in a direction perpendicular to the direction of steam released through at least one steam nozzle, the extended U-shaped portion having a width greater than the width of the elongate handle section and positioned in front of a user's hand gripping the elongate handle section so as to protect the user's hand;

the steam head further comprising:

a heating element provided in or adjacent said steam chamber, and configured to evaporate liquid water passing through said steam chamber;

at least one printed circuit board comprising power conversion electronics and a thermostat to power and control the heating element;

a liquid water tube configured to fluidly interconnect the water outlet of the water pump in the base body and the liquid water inlet of the steam chamber in the steam head, a liquid water flow control valve disposed in one of a fluid connection between the water tank and the water inlet of the water pump and the liquid water tube, wherein a flow rate of the liquid water flow control valve is manually controlled, and a chemical dispenser that is included in the water tank.

2. The garment steamer according to claim 1, further comprising a flexible connection cord that interconnects the base body and the steam head, and that accommodates at least a portion of the liquid water tube, said connection cord having an outer diameter smaller than 10 mm.

3. The garment steamer according to claim 1, wherein the water tank has a volume in the range of 350-750 cubic centimeters.

4. The garment steamer according to claim 1, wherein the steam head has a dry mass smaller than 800 grams.

5. The garment steamer according to claim 4, wherein the steam head has a dry mass of 750 grams.

6. The garment steamer according to 1, further comprising a fastener that is attached to said base body, configured to enable a user to fasten the base body to the user's body.

7. The garment steamer according to claim 1, wherein the water pump is a diaphragm pump.

8. The garment steamer according to claim 1, wherein the base body defines a refill opening that provides direct access to the water tank.

9. The garment steamer according to claim 1, wherein the at least one steam nozzle is encircled by a spacer bracket that prevents a substantially planar object from direct contact with said steam nozzle.

10. The garment steamer according to claim 1, wherein the steam outlet of the steam chamber is always open.

11. The garment steamer according to claim 1, wherein the base body does not accommodate a heating element for evaporating liquid water.

12. The garment steamer according to claim 1, wherein the steam head does not include a liquid water reservoir with a volume larger than 15 cubic centimeters.

13. The garment steamer according to claim 1, the garment steamer being configurable to:

fill the water tank with water via a refill opening in the water tank;

power and control the heating element to a preset temperature by the power conversion electronics and the thermostat provided on the printed circuit board integrated within the steam head;

activate the pump to draw liquid from the water tank through a tube section to force the liquid through the tube section at a rate determined by the manually controlled liquid water flow control valve to the steam chamber in the steam head, generate steam in the steam head using the drawn liquid;

release said generated steam through the at least one nozzle of the steam head and move the steam head along a provided fabric.

14. The garment steamer according to claim 13, wherein releasing the steam through the at least one nozzle of the garment steamer steam head further comprises: pumping liquid water from the water tank through the liquid water tube to the steam chamber.

15. The garment steamer according to claim 1, wherein the chemical dispenser is configured to give off at least one chemical to passing water.

16. The garment steamer according to claim 15, wherein the chemical is one of a fragrance or an additive.

17. The garment steamer according to claim 1, wherein the base body includes:

a back cover, further including a back wall with a first upstanding wall provided thereon, the first upstanding wall extending partially along and partially within a circumference of the back wall, a tank cover, including a front wall, and a second upstanding wall extending partially along and partially within a circumference of the front wall, a top cover, wherein the first and second upstanding walls are complementary shaped such that when the back cover and the tank cover are slid onto one another, the back wall, front wall and first and second upstanding walls define the liquid water tank.

* * * * *